US010871024B2

(12) United States Patent
Carleton

(10) Patent No.: US 10,871,024 B2
(45) Date of Patent: Dec. 22, 2020

(54) FRAME SYSTEM

(71) Applicant: Baron Carleton, Tualatin, OR (US)

(72) Inventor: Baron Carleton, Tualatin, OR (US)

( * ) Notice: Subject to any disclaimer, the term of this patent is extended or adjusted under 35 U.S.C. 154(b) by 0 days.

(21) Appl. No.: 16/211,025

(22) Filed: Dec. 5, 2018

(65) Prior Publication Data

US 2019/0169919 A1 Jun. 6, 2019

Related U.S. Application Data

(60) Provisional application No. 62/595,493, filed on Dec. 6, 2017.

(51) Int. Cl.

| | |
|---|---|
| ***E06B 1/36*** | (2006.01) |
| ***E06B 1/34*** | (2006.01) |
| ***E06B 1/52*** | (2006.01) |
| ***E06B 1/04*** | (2006.01) |
| ***E06B 1/20*** | (2006.01) |
| *E06B 3/62* | (2006.01) |
| *E06B 3/58* | (2006.01) |

(52) U.S. Cl.

CPC ..... *E06B 1/36* (2013.01); *E06B 1/045* (2013.01); *E06B 1/20* (2013.01); *E06B 1/34* (2013.01); *E06B 1/366* (2013.01); *E06B 1/52* (2013.01); *E06B 1/524* (2013.01); *E05Y 2900/132* (2013.01); *E05Y 2900/148* (2013.01); *E06B 3/5857* (2013.01); *E06B 2003/6223* (2013.01); *E06B 2003/6255* (2013.01)

(58) Field of Classification Search

CPC ..... E05Y 2900/132; E05Y 2900/148; E06B 1/045; E06B 1/20; E06B 1/34; E06B 1/36; E06B 1/366; E06B 1/52; E06B 1/524; E06B 3/5857; E06B 2003/6223; E06B 2003/6255

See application file for complete search history.

(56) References Cited

U.S. PATENT DOCUMENTS

| | | | | | |
|---|---|---|---|---|---|
| 1,928,262 | A * | 9/1933 | Nyberg | E05F 7/04 | 49/415 |
| 2,062,775 | A * | 12/1936 | Appleby | E05D 13/1253 | 16/198 |
| 2,274,854 | A * | 3/1942 | Stewart | E06B 3/50 | 292/160 |
| 2,902,729 | A * | 9/1959 | Gillespie | E05D 15/52 | 49/390 |
| 2,927,352 | A * | 3/1960 | Chenoweth | E06B 7/00 | 49/380 |
| 3,267,631 | A * | 8/1966 | Hammitt | E04B 2/74 | 52/771 |
| 3,284,976 | A * | 11/1966 | Kadish | E06B 3/5857 | 52/455 |
| 3,334,463 | A * | 8/1967 | Muessel | E06B 3/60 | 52/775 |

(Continued)

*Primary Examiner* — James M Ference

(74) *Attorney, Agent, or Firm* — Patenttm.us; James H Walters

(57) ABSTRACT

A window and door frame system comprising members that fit together to enable a wide variety of window and door frame configurations and sizes to be constructed. The system comprises interlocking components that can be arranged in a variety of spacing combinations to enable building of frames in different configurations with a small set of components.

11 Claims, 18 Drawing Sheets

(56) References Cited

U.S. PATENT DOCUMENTS 3,393,486 A * 7/1968 Pasche ..... E06B 3/5828 52/204.593
3,433,957 A * 3/1969 Nelson ..... E06B 3/5857 250/517.1
3,455,080 A * 7/1969 Meadows ..... E06B 3/5857 52/476
3,750,358 A * 8/1973 Lewkowitz ..... E06B 3/5857 52/204.597
3,846,948 A * 11/1974 Dallen ..... E06B 3/5409 52/204.597
3,858,377 A * 1/1975 Browne ..... E04B 1/6116 52/775
3,918,231 A * 11/1975 Kessler ..... E06B 3/305 52/844
4,387,542 A * 6/1983 Wehr ..... E06B 1/32 52/204.591
4,539,243 A * 9/1985 Miller ..... E06B 3/5857 428/34
4,625,479 A * 12/1986 Giguere ..... E06B 3/645 52/202
4,628,648 A * 12/1986 Winyard ..... E06B 3/26338 49/505
4,702,050 A * 10/1987 Giguere ..... E06B 3/645 52/202
5,189,862 A * 3/1993 Lafleur ..... E06B 3/2605 52/204.593
5,379,518 A * 1/1995 Hopper ..... E06B 3/22 29/415
5,444,958 A * 8/1995 Lu ..... E05D 7/1005 52/204.67
5,692,349 A * 12/1997 Guillemet ..... E06B 3/5892 52/204.53
6,711,870 B1 * 3/2004 Richardson ..... E04D 3/08 52/775
7,562,504 B2 * 7/2009 Herbst ..... E04F 13/0805 52/235
9,127,498 B1 * 9/2015 Ye ..... E06B 3/24
9,303,444 B1 * 4/2016 Choi ..... E06B 3/549
2008/0010919 A1 * 1/2008 Tufts ..... E06B 1/366 52/204.591
2010/0192488 A1 * 8/2010 Campbell ..... E06B 7/14 52/209
2011/0239560 A1 * 10/2011 Landeros ..... E06B 3/305 52/204.61
2017/0183896 A1 * 6/2017 Dastrup ..... E06B 3/4609
2017/0328117 A1 * 11/2017 Wang ..... E06B 3/30
2018/0135346 A1 * 5/2018 Warren ..... E06B 1/04
2019/0169919 A1 * 6/2019 Carleton ..... E06B 1/34

* cited by examiner

FIG. 6
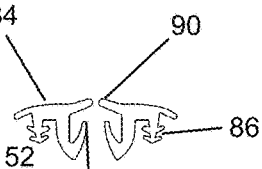
FIG. 4
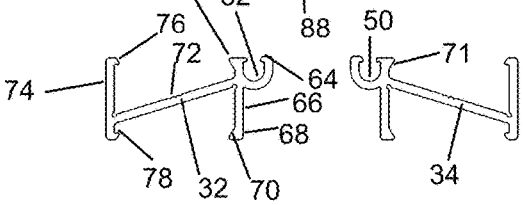
FIG. 5A
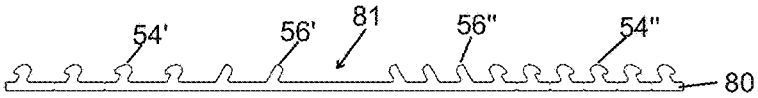
FIG. 5B
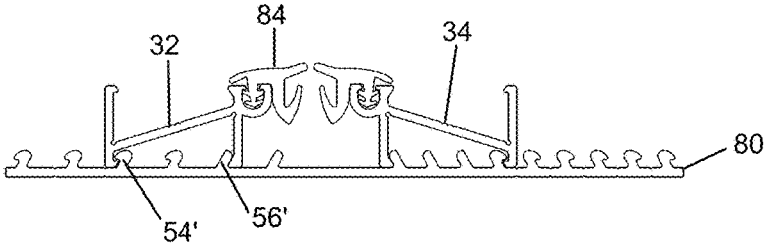
FIG. 9
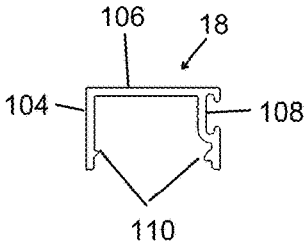
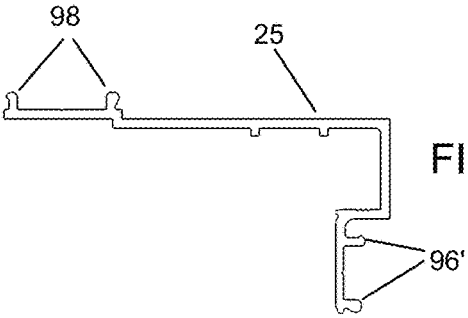
FIG. 8
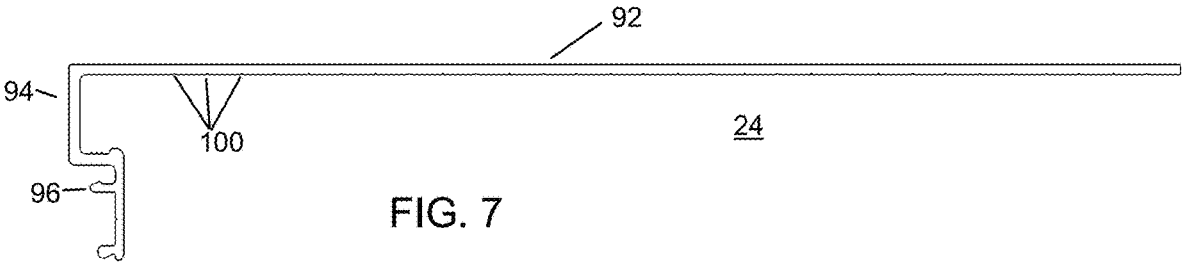
FIG. 7

FIG. 10A
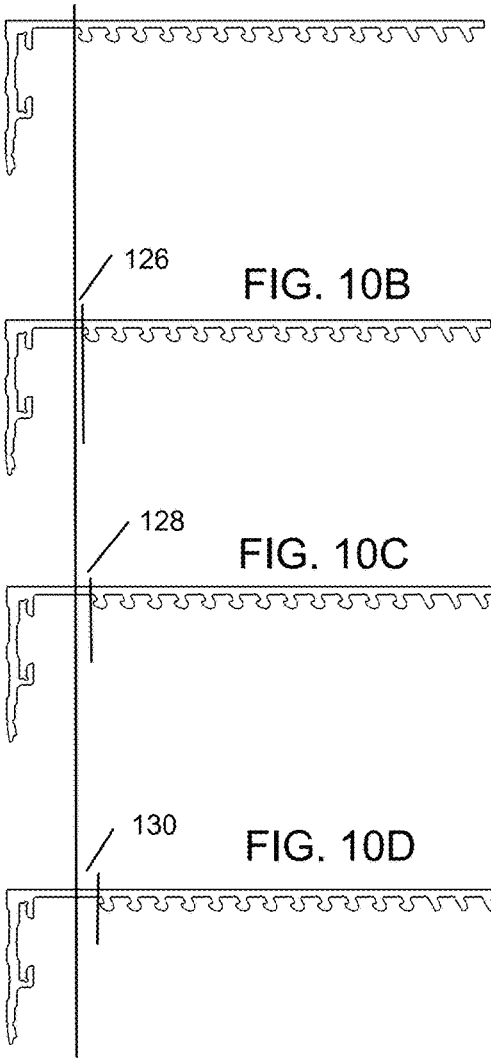
FIG. 10B
FIG. 10C
FIG. 10D
FIG. 12A
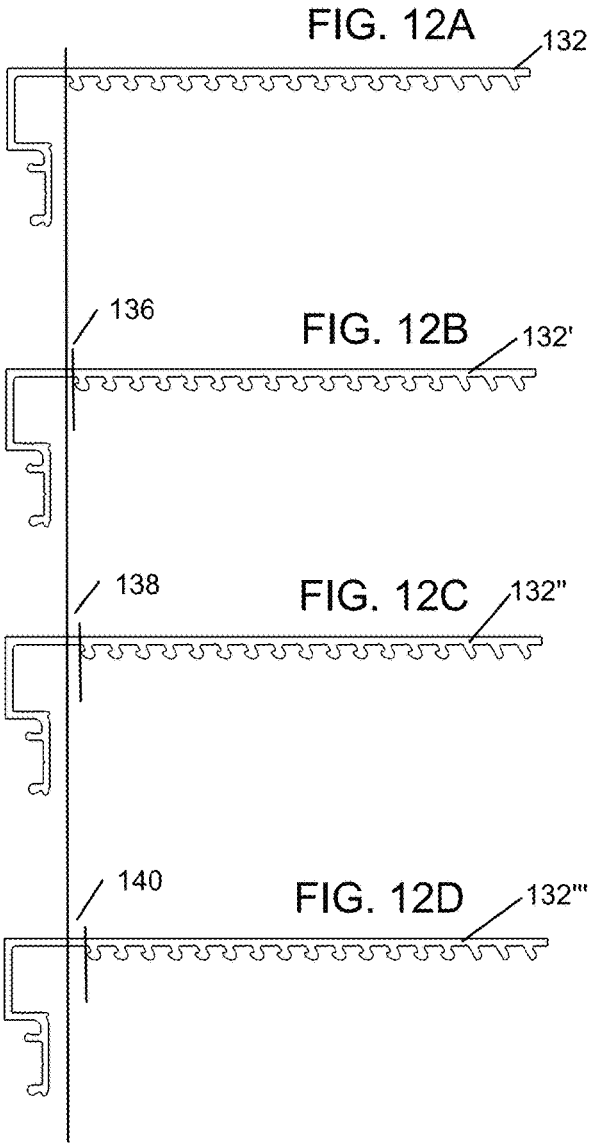
FIG. 12B
FIG. 12C
FIG. 12D

FRAME SYSTEM

CROSS-REFERENCE TO RELATED APPLICATIONS

This application claims benefit of U.S. provisional patent application Ser. 62/595,493, filed Dec. 6, 2017, the disclosure which is herein incorporated by reference in its entirety.

BACKGROUND

This disclosure relates to windows and doors and more particularly to a system for providing frames for doors and/or windows.

Door and window frames need to be built in a variety of dimensions to accommodate the various sites where they will be installed. For a manufacturer to provide many different sizes, many individual component parts must be available for assembly of desired finished sizes. This leaves the manufacturer with a large inventory. To cut down on part inventory, a manufacturer might limit the sizes of finished frames/windows that are available, potentially leading to lost business as customers who need custom-sizing go elsewhere.

SUMMARY

In accordance with the disclosure, a system and method is provided to allow a wide range of frame sizes to be constructed with a relatively low inventory of different component parts.

The subject matter of the present technology is particularly pointed out and distinctly claimed in the concluding portion of this specification. However, both the organization and method of operation, together with further advantages and embodiments thereof, may best be understood by reference to the following description and accompanying drawings wherein like reference characters refer to like elements.

BRIEF DESCRIPTION OF THE DRAWINGS

FIG. 4 is a section view of exemplary glazing stops (32, 34);

FIG. 5A is an end view of a glazing base;

FIG. 5B is an end view of an assembled glazing base;

FIG. 6 is an end view of a pair of glazing members;

FIG. 7 is an end view of a jamb leg;

FIG. 8 is an end view of a door jamb leg;

FIG. 9 is an end view of a door stop;

FIGS. 10A, 10B, 10C and 10D illustrate glazing filler caps with spacing variations which enable a wide range of window spacing configurations to be constructed;

FIGS. 12A, 12B, 12C and 12D illustrate glazing jamb caps with spacing variations which enable a wide range of window spacing configurations to be constructed;

DETAILED DESCRIPTION

The system according to a preferred embodiment of the present disclosure comprises a system and method for construction of door and window frames.

Figure 1:
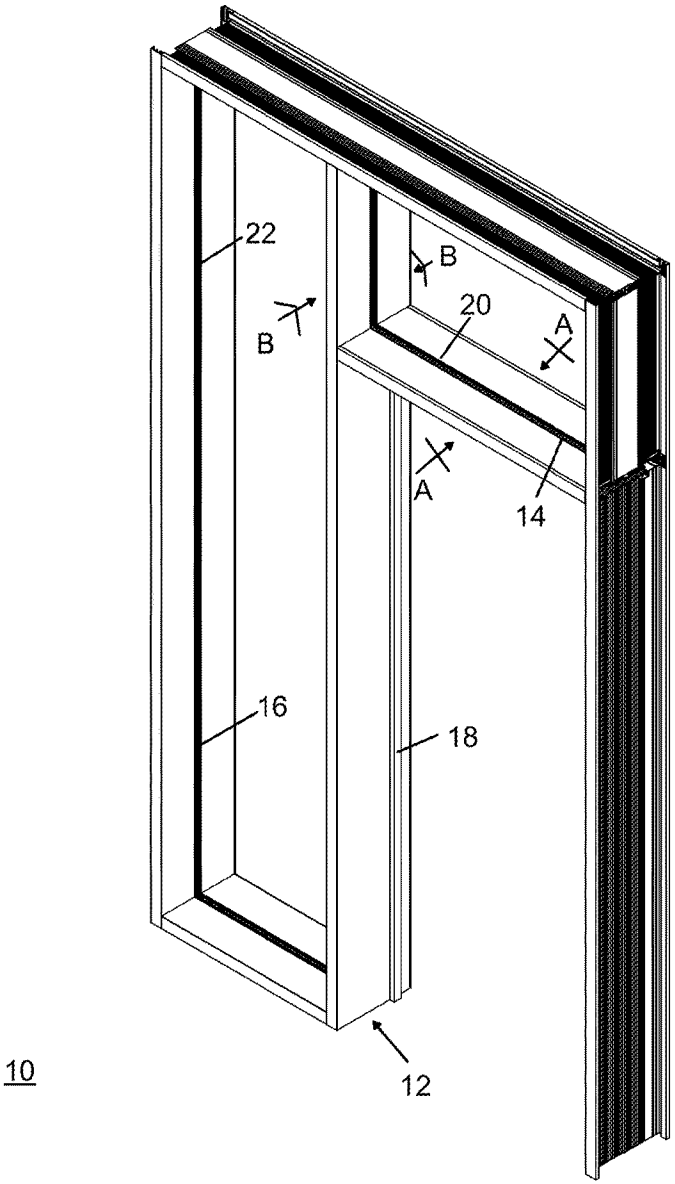
FIG. 1 is a perspective view of an exemplary door frame with transom and side light.

Referring to FIG. 1, a perspective view of an exemplary door frame with a transom and side light, Frame 10 includes a door opening (12) with top transom window opening (14) and sidelight window opening (16). A door stop (18, 27) may be provided in the door opening, extending along both vertical legs of the door opening as well as the horizontal upper leg of the door opening. In the transom window opening and the sidelight window opening, a glazing channel (20, 22) is provided to receive and hold the glass as discussed in further detail hereinbelow.

Figure 2:
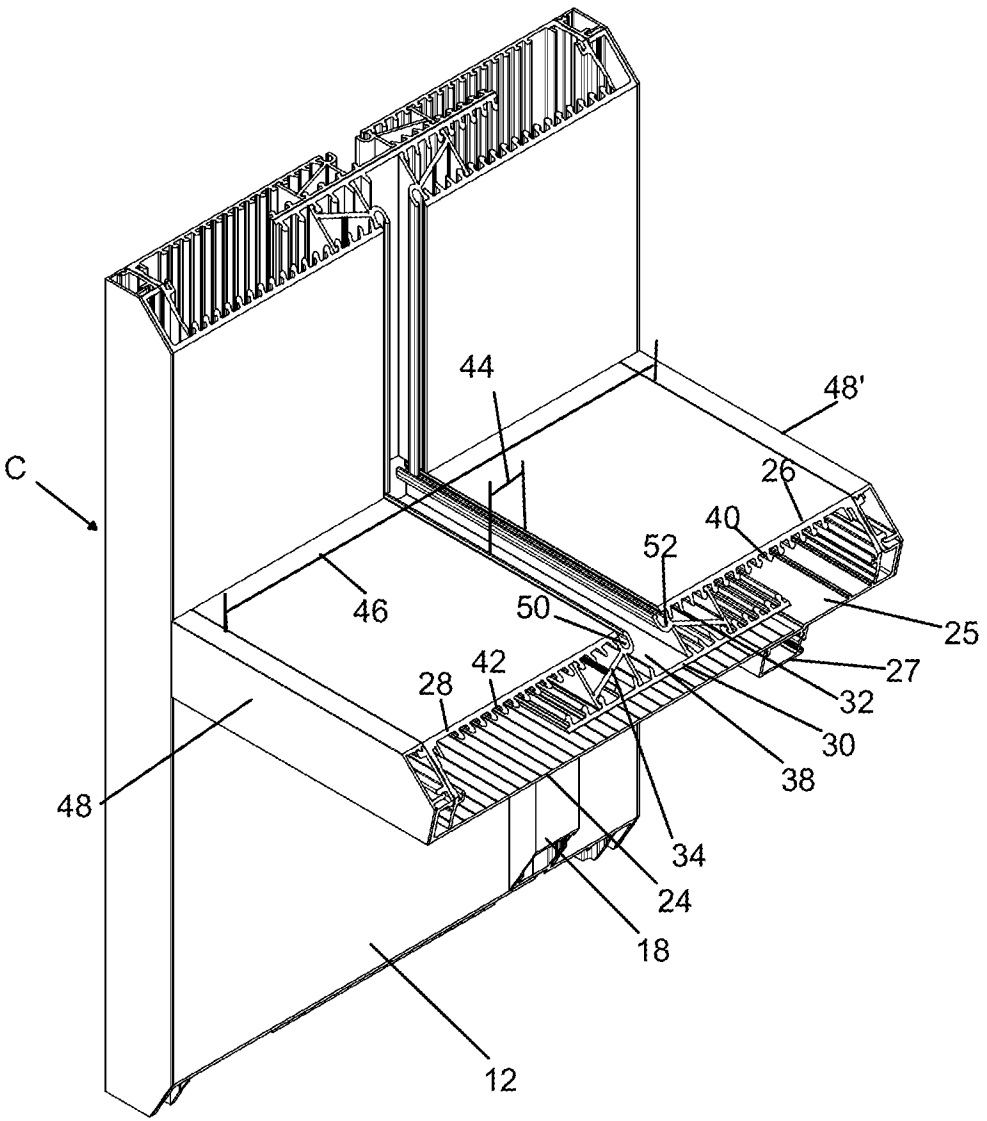
FIG. 2 is a partial perspective sectional view of the door frame of FIG. 1 cut along lines A-A and B-B.

Referring now to FIG. 2—a partial perspective sectional view of the door frame in FIG. 1 cut along lines A-A and B-B—the transom and glazing channel are constructed in the illustrated embodiment of several components: a jamb leg (24); a door jamb leg (25); a door stop (18); left and right upper glazing caps (26, 28); glazing base (30); and left and right glazing stops (32, 34). The glazing base has plural spaced channels (36) defined therein extending substantially the length of the glazing base from each of the left and right outer edges thereof towards the center of the base with a wider central glazing channel (38) defined centrally on the base. The bottom faces of the glazing caps (26, 28) have corresponding plural spaced channels (40, 42) defined therein along substantially all or much of the length of the caps. The glazing stops attach to the channels of both the glazing caps and the glazing base to define the width (44) of the glazing channel and the overall width (46) of the transom. Decorative cover members (48) may be attached to the outer edges of the assembled pieces to provide an aesthetically pleasing appearance. Glazing stops (34) may have a channel (50, 52) defined therein which operates to receive glazing members, which may include vinyl, rubber, silcone, caulk, etc., as discussed hereinbelow.

Figure 3:
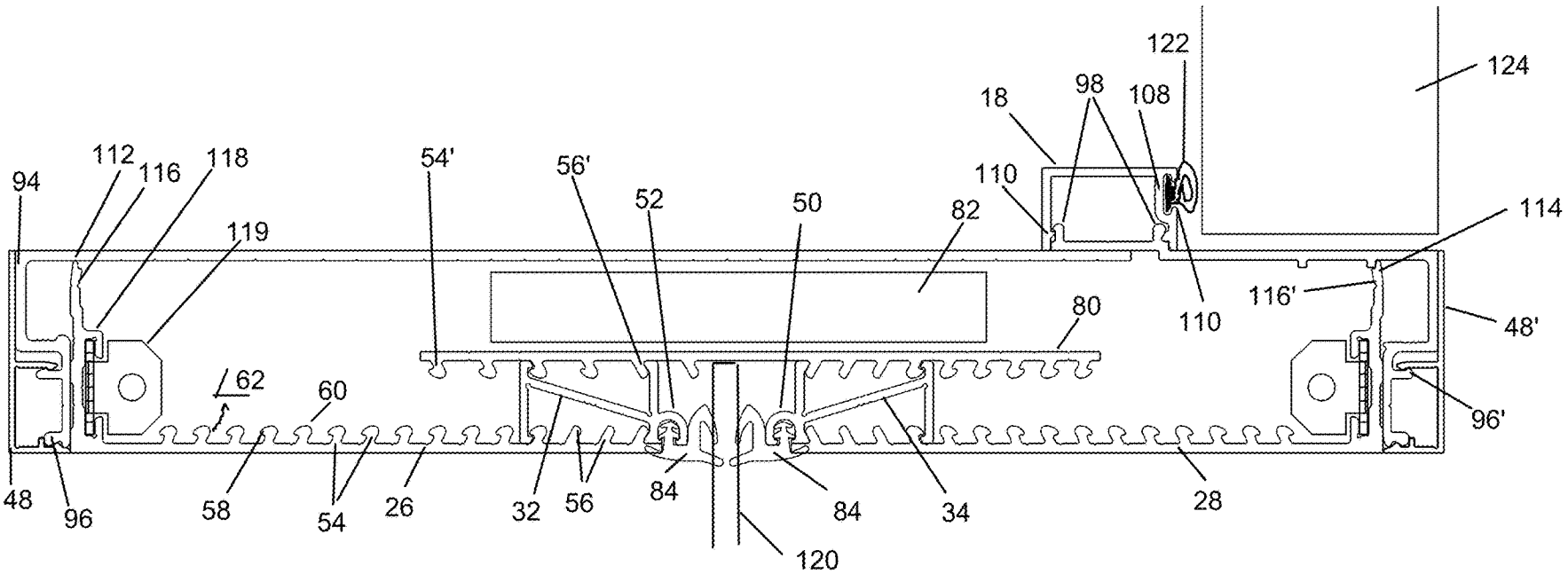
FIG. 3 is an end view of a portion of the assembled sidelight/transom of FIG. 2 taken in the direction of arrow C in FIG. 2.

Referring to FIG. 3—an end view of a portion of the assembled sidelight/transom of FIG. 2 taken in the direction of arrow C in FIG. 2—left and right glazing caps (26, 28) have plural latch hook members (54, 56) defined on the inner faces thereof, members (54) beginning towards the outer edges of the caps and extending inwardly toward the inner edge of the cap. Hook members (54) in this embodiment have a bulbous uppermost portion comprising a curved rear top portion (60) and a lip (58) outwardly oriented to define the hook portion. The lower, thinner portions of the hook members extend inwardly from the inward faces of the caps (26, 28) at an angle (62) in the illustrated embodiment. Hook members (56) are defined most inwardly of the glazing caps and do not have the lip member (58) nor bulbous portion (60). In the illustrated embodiment, there are 3 such hook members (56) on each cap. Other directional orientations and shapes of the hook members can be employed, the illustrated versions being just one example.

Glazing stops (32, 34) are illustrated in FIG. 4, a section view of exemplary glazing stops. The glazing stops have the glazing members' receiving channels (50, 52) which are suitably semicircular in the particular embodiment with slight inwardly extending projections (64) at the upper edges of the channels for receiving a glazing member therein. The edge of the channel member that is oriented towards the center of the glazing stop has an angled face (71). A support leg (66) extends downwardly below the channel to a foot member (68). The inner face of the foot member has an angled face (70) which is angled away from the side of the channel. An angled support (72) extends down from the base of the channels towards an opposite vertical member (74) which has upper and lower hook member (76, 78) defined oriented towards the channels.

Referring back to FIG. 3, the glazing stops (32, 34) interact with the glazing caps (26, 28) as follows:

The stop is positioned near the inner edge of the glazing cap with the channel (50, 52) oriented toward the hook member. The angled face (71) is positioned against the angled hook member (56), and the opposite leg (74) of the glazing stop is pushed downwardly so that the hook (76) interacts with the lip (52) of hook (54)—snapping the glazing stop into place. The pieces can also be slid together from their respective ends rather than pushing/snapping.

Now, glazing base (30) can be positioned to snap into position on the opposite ends of legs (66, 74) of the glazing caps to secure the assembly together.

A glazing base member (80)—illustrated separately in FIG. 5A, an end view of a glazing base—carries correspondent hook members (54', 56') to those on glazing caps (26, 28). One end of the glazing base (80) has a first spacing between hook members (54', 56'), for example, while the other end of member (80) has a second spacing between hook members (54", 56"), for example, which allows various width configurations to be assembled for accommodating various glass configurations, spacings, and widths, if desired. A central space (81) is provided on the face of the glazing base with hook members to accommodate the edge of any glass that is installed in the window as well as glass supports if required (e.g. glazing blocks).

Referring to FIG. 5B—an end view of an assembled glazing base—the hook members on the glazing base engage with foot member (68) and lower hook member (78). The angled face (70) of the glazing stop member interacts with the correspondingly angled hook member (56'). The lower hook member (78) of the glazing stop latches to a corresponding hook member (54'). Which particular hook member (54', 56') is engaged depends on the particular spacing required for the specific configuration of window being constructed.

Figure 5C:
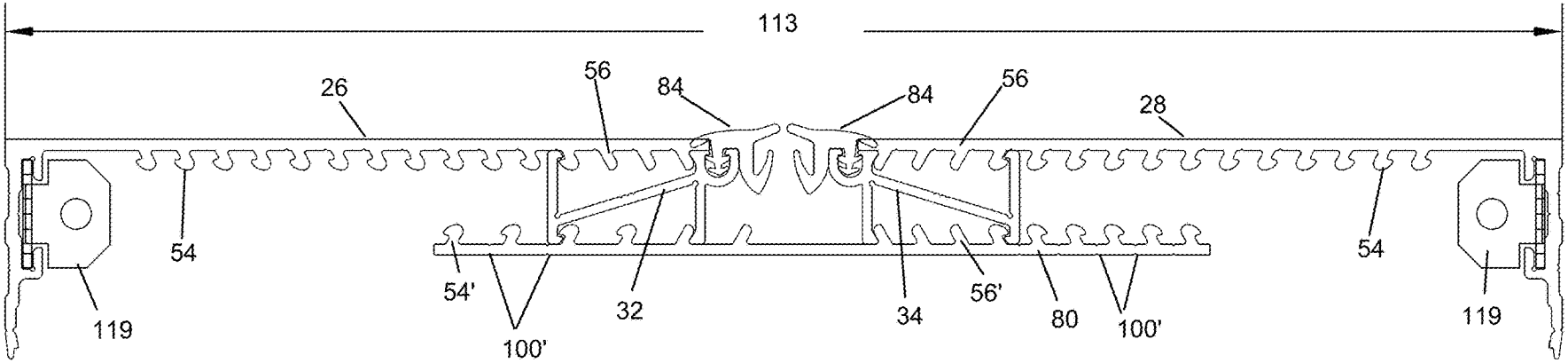
FIG. 5C is an end view of an assembled glazing filler.

FIG. 5C—an end view of an assembled glazing filler—shows attachment of glazing caps (26, 28) to the assembled glazing base by interaction of the angled face (70) and hook (76) with corresponding shape profiles of latch hook members (56, 54). In this configuration, dimension (113) might be 10.125 inches, as an example.

Referring back to FIG. 3, an ancillary support bar (82) may be mounted to the side of glazing base (80) opposite the hook members thereon. If used, the support provides additional structural rigidity to the assembly in configurations having larger size glass installations or multiple panes of glass.

Push-in glazing members (84)—illustrated in FIG. 6, an end view of a pair of glazing members—include engaging fingers (86) adapted to interact with glazing stop channels (50, 52) and glass engaging fingers (88, 90) for interacting with glass installed in the frame.

Continuing with FIG. 3, the smaller fingers (86) of the push-in glazing members are pressed into glazing stop channels (50, 52) which will secure the glazing members to the frame. The larger fingers (88, 90) can then hold any glass positioned between the glazing members. The glazing members (50, 52) are suitably made of vinyl in a particular embodiment.

Jamb leg (24)—illustrated in FIG. 7, an end view thereof—comprises a substantially straight leg (92) and an outer face (94) which is at a right angle to the straight leg in this embodiment. Mounting hooks (96) are provided below the outer face (94) for attaching a decorative cover member (48) which snaps or slides into place as shown in FIG. 2. Plural score lines (100) are provided on the over the bulk of the length of jamb leg (24) on the inner face allowing the overall length of the leg (92) to be adjusted by cutting or snapping off excess length of the leg (92). This makes the jamb leg easily adjusted to be the desired length for the particular configuration being constructed.

FIG. 8—an end view of a door jamb leg 25—shows a right-angle member with one leg longer than the other. The longer leg carries door stop mounting hooks (98) for attaching a door stop. The other mounting hooks (96') provided are for attaching a decorative cover member.

FIG. 9 is an end view of a door stop (18) which includes right angle faces (104, 106), a seal receiving channel (108), and engaging projections (110). A suitable weather/light/sound seal may be attached in the receiving channel which might comprise a vinyl, wool pile, or other suitable seal.

With continued reference to FIG. 3, glazing caps (26, 28) have break off leg members (112, 114) extending from the distal ends of the caps to define the depth of the frame member between the outer faces of the glazing caps and the jamb leg/door jamb leg. The legs having score lines (116, 116') defined therein to provide positions at which the length of the legs may be adjusted by cutting or snapping off excess length. The glazing caps have mullion attachment clips (118) defined in the inner faces of the outer edges thereof. A mullion (119) clip may be attached thereto allowing a mullion to be connected to the assembled piece when constructing an overall frame configuration. The mullion clip may be secured by use of a screw or another fastening device or by collapsing the mullion clip channel.

The illustrated configuration is assembled by positioning the glazing caps and jamb legs together with the break off legs adjusted to the desired length. The configuration may then be secured together by any suitable means, such as driving screw fasteners or rivets through the side walls of the components; using adhesive, double sided tape, or other fasteners; or welding of the edges together.

The door stop (18) is snapped or slid into position on the door jamb leg via interaction of door stop mounting hooks (98) and engaging projections (110). The window glass (120) is held in position in the glazing base by the fingers of the push-in glazing. A sound/light seal (122) may be inserted into seal receiving channel (108) for a sealing interaction with a door (124) when the door is closed.

The configuration illustrated so far is for a door/transom window frame. However, the system according to the disclosure is adaptable for use in a wide variety of door/window/frame configurations.

FIGS. 10A, 10B, 10C and 10D illustrate glazing filler caps having spacing variations to allow a wide range of window configurations to be employed. In a particular embodiment, the spacing of the latch hook members (54, 56) is such that each member is $1/4^{th}$ inch apart from an adjacent member. By providing plural glazing filler caps with slightly different configurations, a variety of window configurations can be constructed with $1/16^{th}$ inch spacing choices. As illustrated the member spacing (126) of FIG. 10B is $1/16^{th}$ inch off of that of FIG. 10A; FIG. 10C spacing (128) is $2/16^{th}$ inch of that of FIG. 10A; and FIG. 10C spacing (130) is $3/16^{th}$ inch of that of FIG. 10A. Of course, other dimensions can be employed to provide the desired adaptability to the system.

Figure 11:
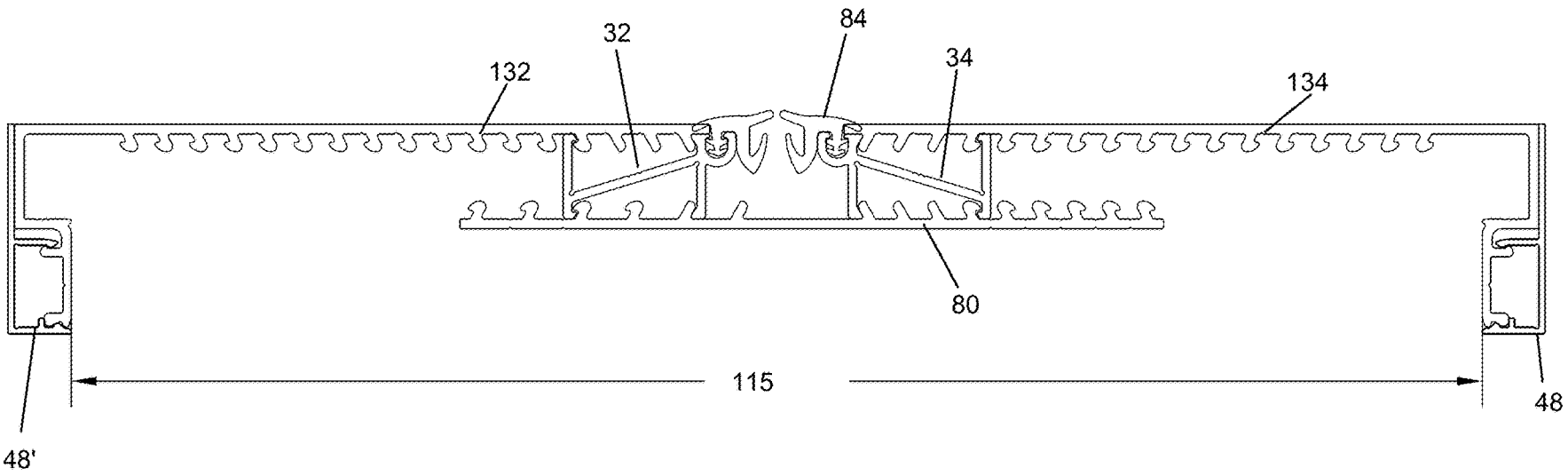
FIG. 11 is an end view of an assembled glazing jamb window frame configuration.

For construction of other configurations, a glazing jamb cap (132) is provided as shown in FIG. 11—an end view of an assembled window frame configuration. In this configuration, left and right glazing jamb caps (132, 134) are assembled with glazing stops (32, 34), glazing base member (80), and push-in glazing members (84). Decorative cover members (48, 48') are also illustrated. Dimension (115) might be 10.125 inches in this configuration.

In a manner corresponding to the glazing filler caps, multiple configurations of the glazing jamb caps can be provided—as shown in FIGS. 12A-12D—with offset spacing (136, 138, 140) from the glazing jamb cap (132) to allow for window placement spacing variables of less than the spacing width of the latch hook members (54', 56').

FIGS. 13A-13F are side views that illustrate various glass thicknesses and the configurations employed to accommodate them.

Figure 13A:
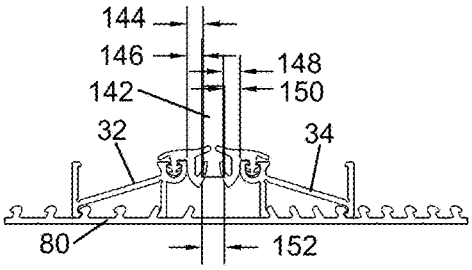
FIGS. 13A, 13B, 13C, 13D, 13E and 13F are side views that illustrate various glass thicknesses and the configuration employed to accommodate them.

In FIG. 13A, ¼ inch glass (142) is accommodated with the glazing stops (32, 34) positioned on latch hook members (54, 56) as illustrated. The leg (66) of one stop (32) is positioned 1 hook member in from the center on the left side of glazing base (80), and the leg (66) of the other stop (34) is at the centermost hook member of the right side of the glazing base (80). In this configuration, dimension (144) is 0.1799, (146) is 0.1674, (148) is 0.1798, and (150) is 0.1673. Dimension (152) is 0.2440.

Figure 13B:
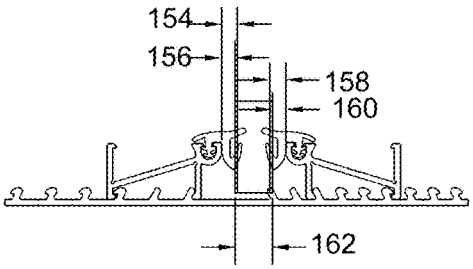

FIG. 13B illustrates ⅜ inch glass. In this configuration, the leg (66) of one stop (32) is positioned at the centermost hook member on the left side of glazing base (80), and the leg (66) of the other stop (34) is 2 members in from the center of the right side of the glazing base (80). In this configuration, dimension (154) is 0.1744, (156) is 0.1489, (158) is 0.1743, and (160) is 0.1488. Dimension (162) is 0.2440.

Figure 13C:
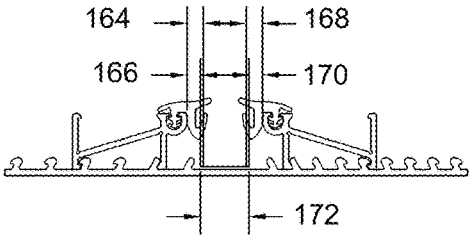

FIG. 13C illustrates ½ inch glass. In this configuration, the leg (66) of one stop (32) is positioned 1 stop in from the centermost hook member on the left side of glazing base (80), and the leg (66) of the other stop (34) is 1 member in from the center of the right side of the glazing base (80). In this configuration, dimension (164) is 0.1799, (166) is 0.1489, (168) is 0.1798, and (170) is 0.1488. Dimension (172) is 0.5310.

Figure 13D:
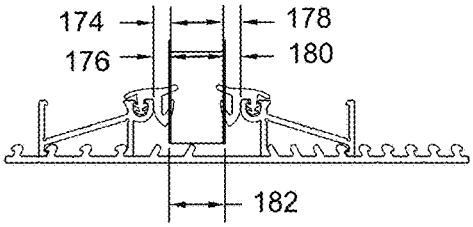

FIG. 13D illustrates ⅝ inch glass. In this configuration, the leg (66) of one stop (32) is positioned 2 stops in from the centermost hook member on the left side of glazing base (80), and the leg (66) of the other stop (34) is at the centermost member of the right side of the glazing base (80). In this configuration, dimension (174) is 0.1915, (176) is 0.1720, (178) is 0.1912, and (180) is 0.1717. Dimension (182) is 0.6100.

Figure 13E:
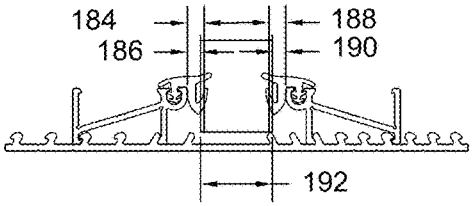

FIG. 13E illustrates ¾ inch glass. In this configuration, the leg (66) of one stop (32) is positioned 1 stop in from the centermost hook member on the left side of glazing base (80), and the leg (66) of the other stop (34) is 2 members in from the center of the right side of the glazing base (80). In this configuration, dimension (184) is 0.1849, (186) is 0.1459, (188) is 0.1848, and (190) is 0.1458. Dimension (192) is 0.7870.

Figure 13F:
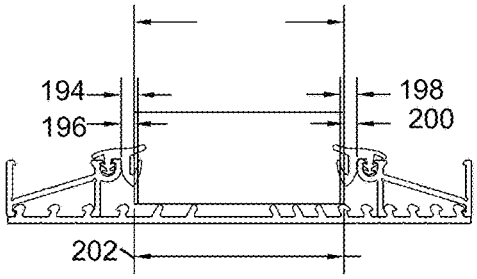

FIG. 13F illustrates 2¼ inch glass. In this configuration, the leg (66) of one stop (32) is positioned 3 stops in from the centermost hook member on the left side of glazing base (80), and the leg (66) of the other stop (34) is 5 members in from the center of the right side of the glazing base (80). In this configuration, dimension (194) is 0.1807, (196) is 0.1417, (198) is 0.1838, and (200) is 0.1448. Dimension (202) is 2.2922.

Other glass dimensions are possible with changes in the placement of the glazing stops and/or the spacing configuration provided on the glazing base.

Figure 14:
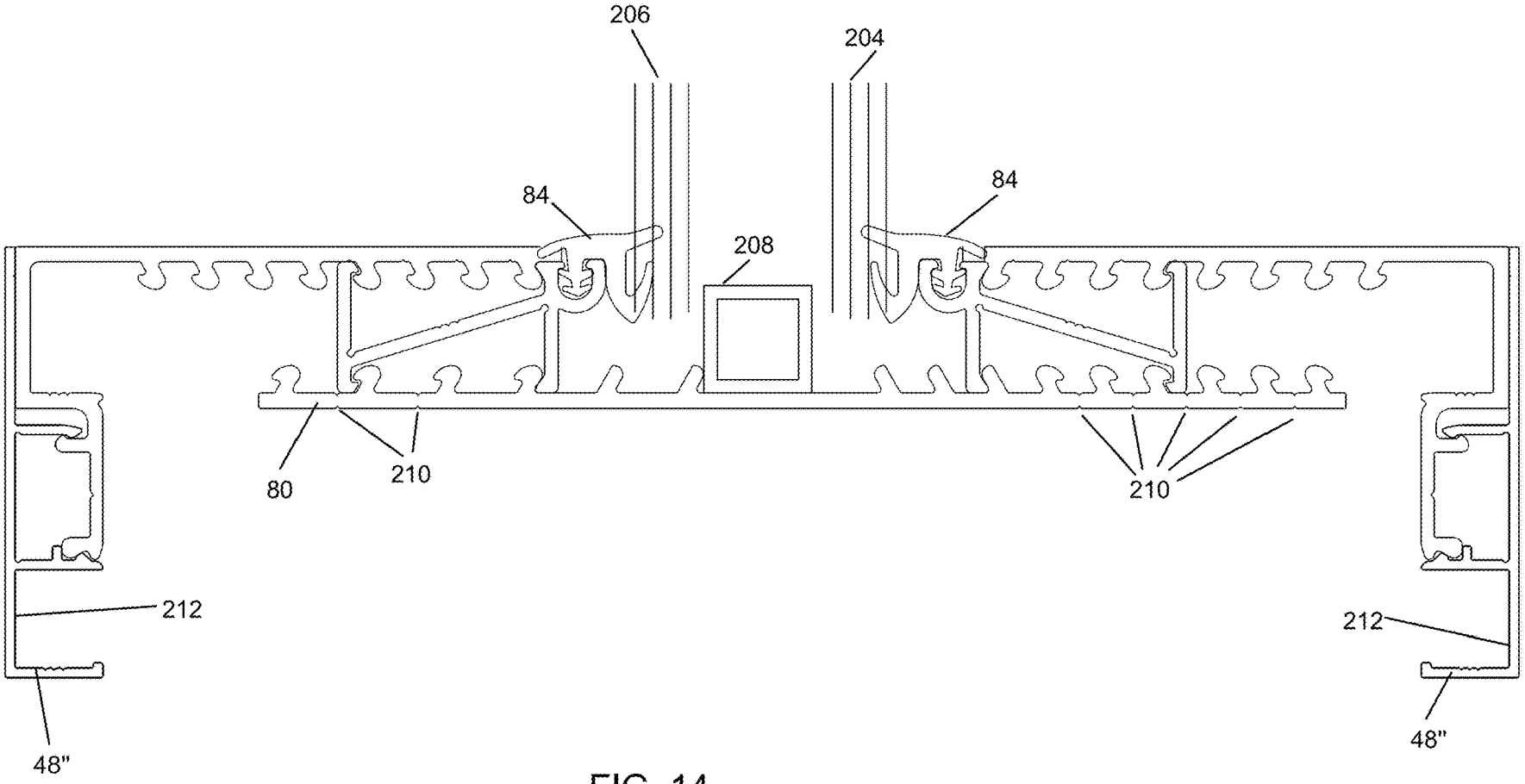
FIG. 14 illustrates a double-glazed jamb.

To illustrate another configuration, FIG. 14 shows a double-glazed jamb, wherein first and second glass panes (204, 206) remain spaced apart by a separator (208). In this view, it may be observed that glazing base (80) can also be provided with plural score lines (210) which enable portions to be snapped off to adjust the overall length of the glazing base as desired for the particular frame configuration being assembled. In this view, decorative cover members (48") have a different configuration that those shown earlier, with an additional lower portion (212) for a longer external face profile.

Figure 15:
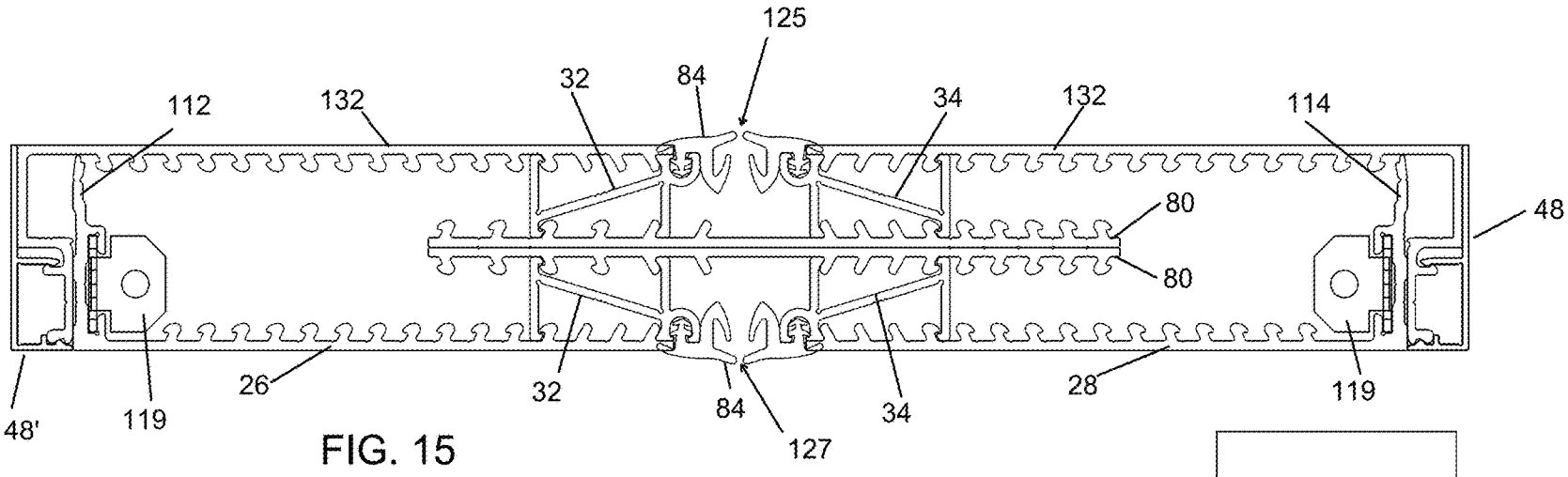
FIG. 15 illustrates an assembled vertical or horizontal mullion configuration.

FIG. 15 illustrates an assembled vertical/horizontal mullion. A pair of glazing bases (80) are oriented back to back. The glazing bases (80) are attached to the upper glazing caps (26, 28) and glazing jam caps (132) by glazing stops (32, 34) connected to each outwardly oriented face of the glazing bases (80) in such a way that glass may be mounted at (125, 127).

Figure 16:
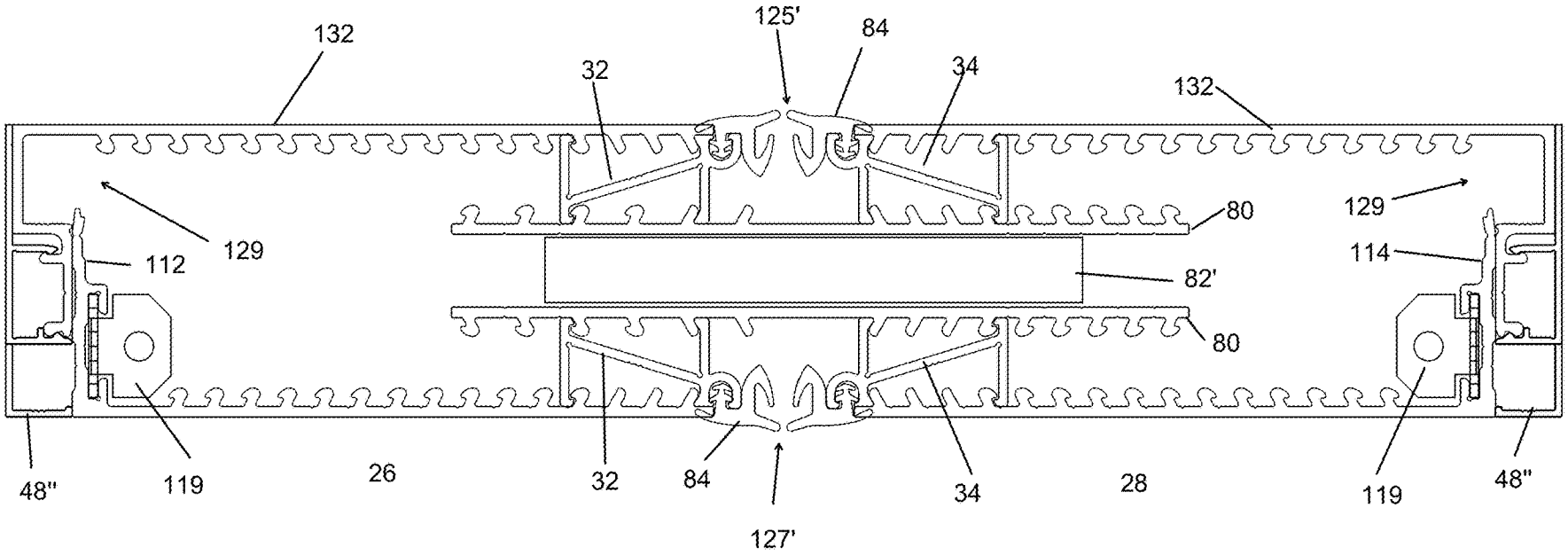
FIG. 16 illustrates an assembled vertical or horizontal mullion configuration with an ancillary support bar.

FIG. 16 is an assembled vertical or horizontal mullion configuration, similar to that of FIG. 15, with ancillary support bar (82') for extra support in situations where additional stiffness to the glass mounting is desired. The overall thickness of the structure is larger in this illustration, as can be observed by the space (129) between the ends of the leg members (112, 114) and the inner face of the glazing jamb cap (132).

Figure 17:
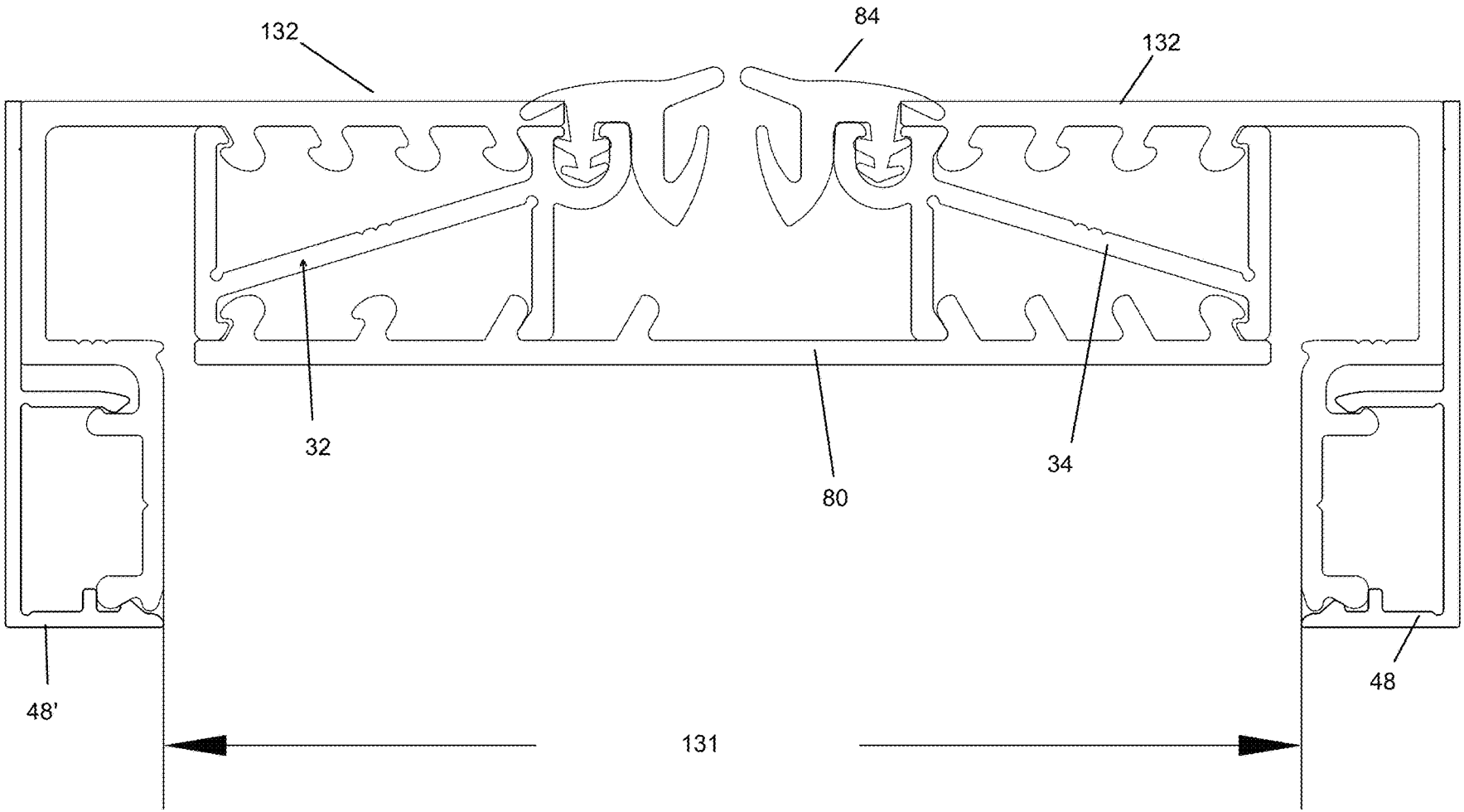
FIG. 17 illustrates a smallest glazing jamb dimension configuration.

FIG. 17 illustrates a smallest glazing jamb dimension configuration, wherein a substantial portion of the length of glazing jamb cap (132) has been snapped or cut at score lines to shorten the overall length of the glazing jam caps. In this particular configuration, dimension (131) might be 3.25 inches, for example.

Figure 18:
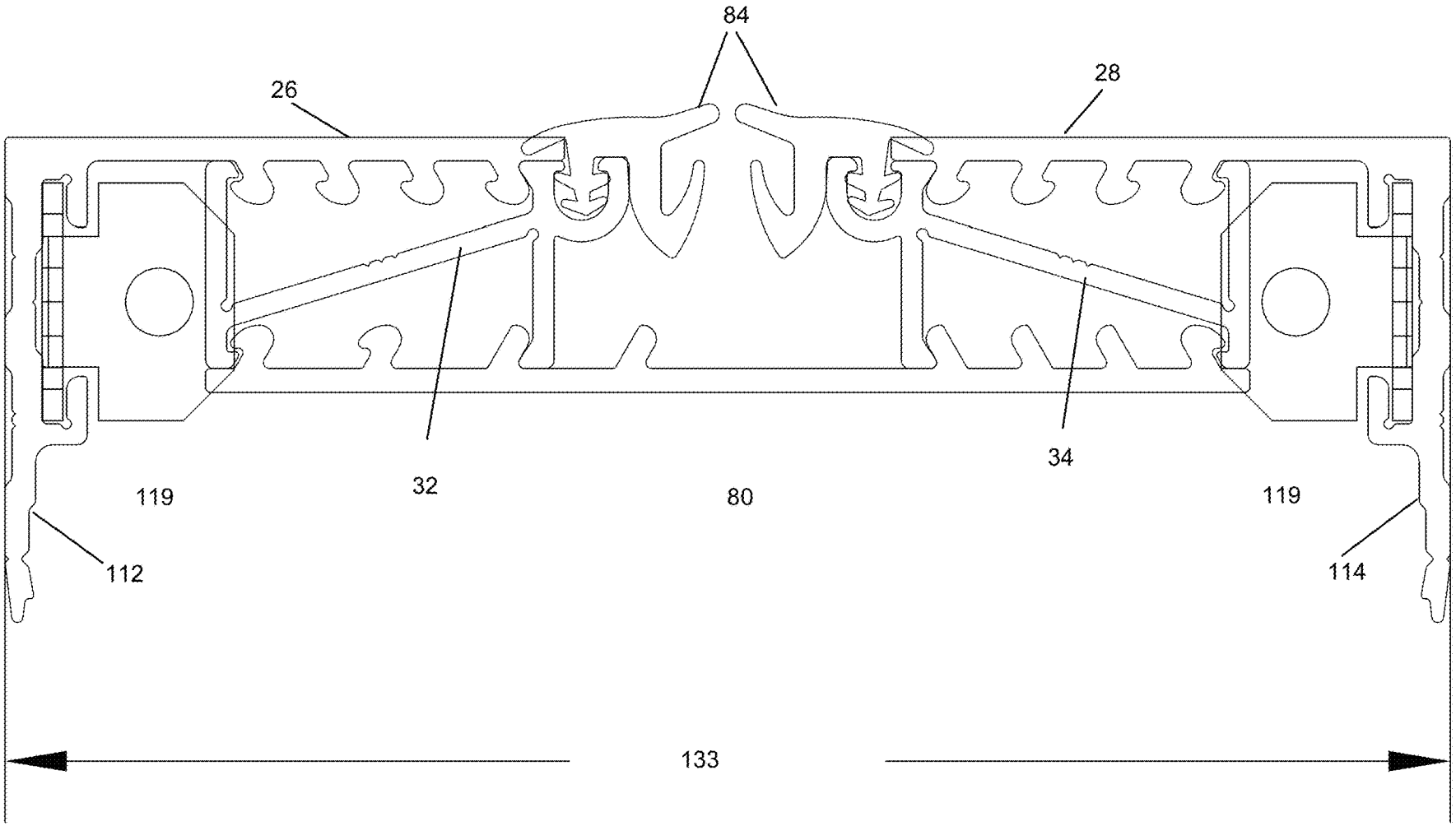
FIG. 18 illustrates a smallest glazing filler dimension configuration.

FIG. 18 illustrates the smallest glazing filler dimension configuration where a substantial portion of the lengths of upper glazing caps (26, 28) have been snapped or cut at score lines to shorten the overall length of the glazing caps. In this particular configuration, dimension (133) might be 4.25 inches, for example.

Figure 19:
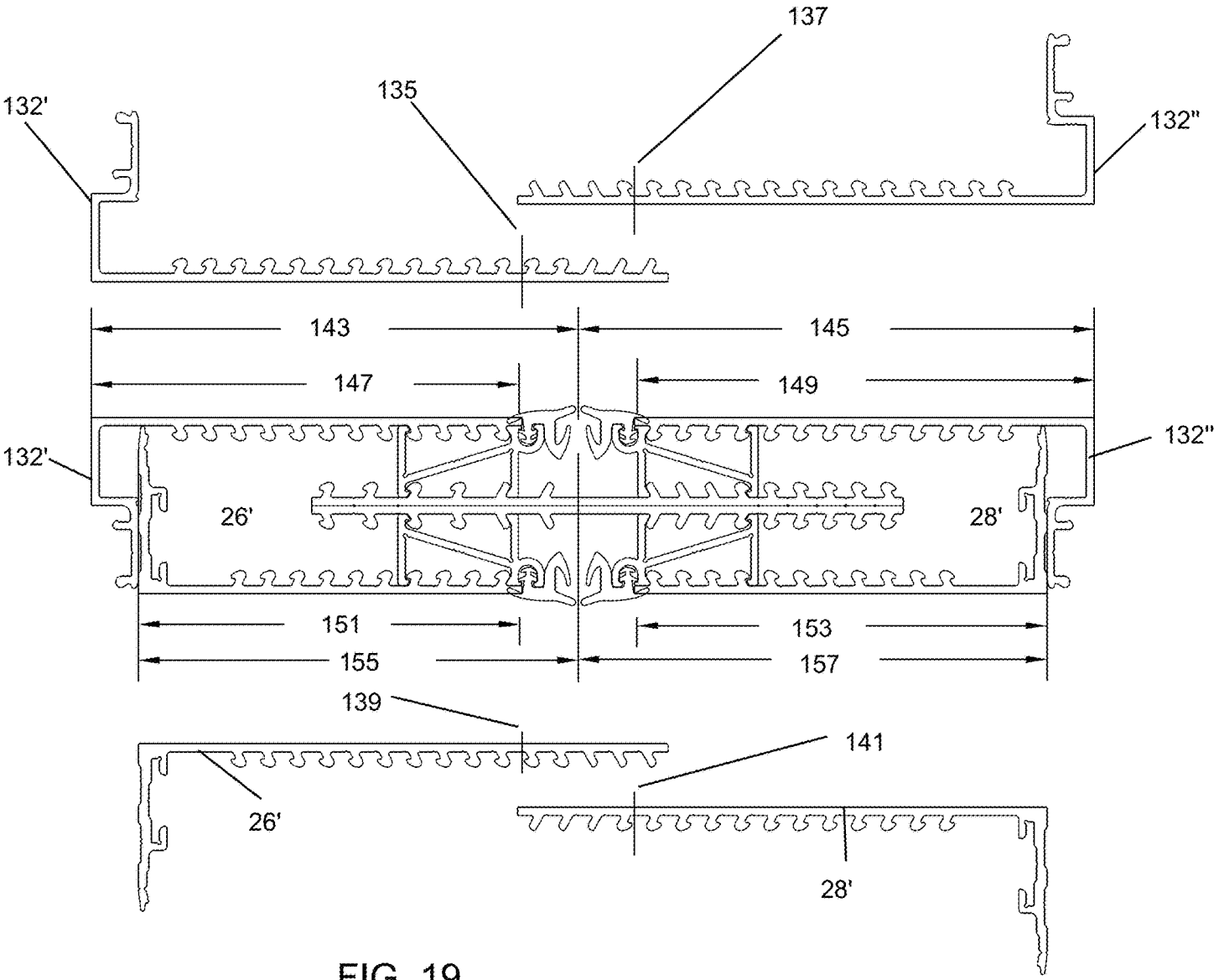
FIG. 19 illustrates an example of an off-center window configuration.

FIG. 19 illustrates an example of construction of an off-center window configuration, where glazing jamb caps (132', 132") are cut/snapped off at score lines (135, 137) and upper glazing caps (26', 28') are cut/snapped off at score lines (139, 141). This example results in the following dimensions: 4.156 inches for (143), 4.405 inches for (145), 3.65 inches for (147), 3.9 inches for (149), 3.25 inches for (151), 3.5 inches for (153), 3.75 inches for (155), and 4.0 inches for (157).

Figure 20:
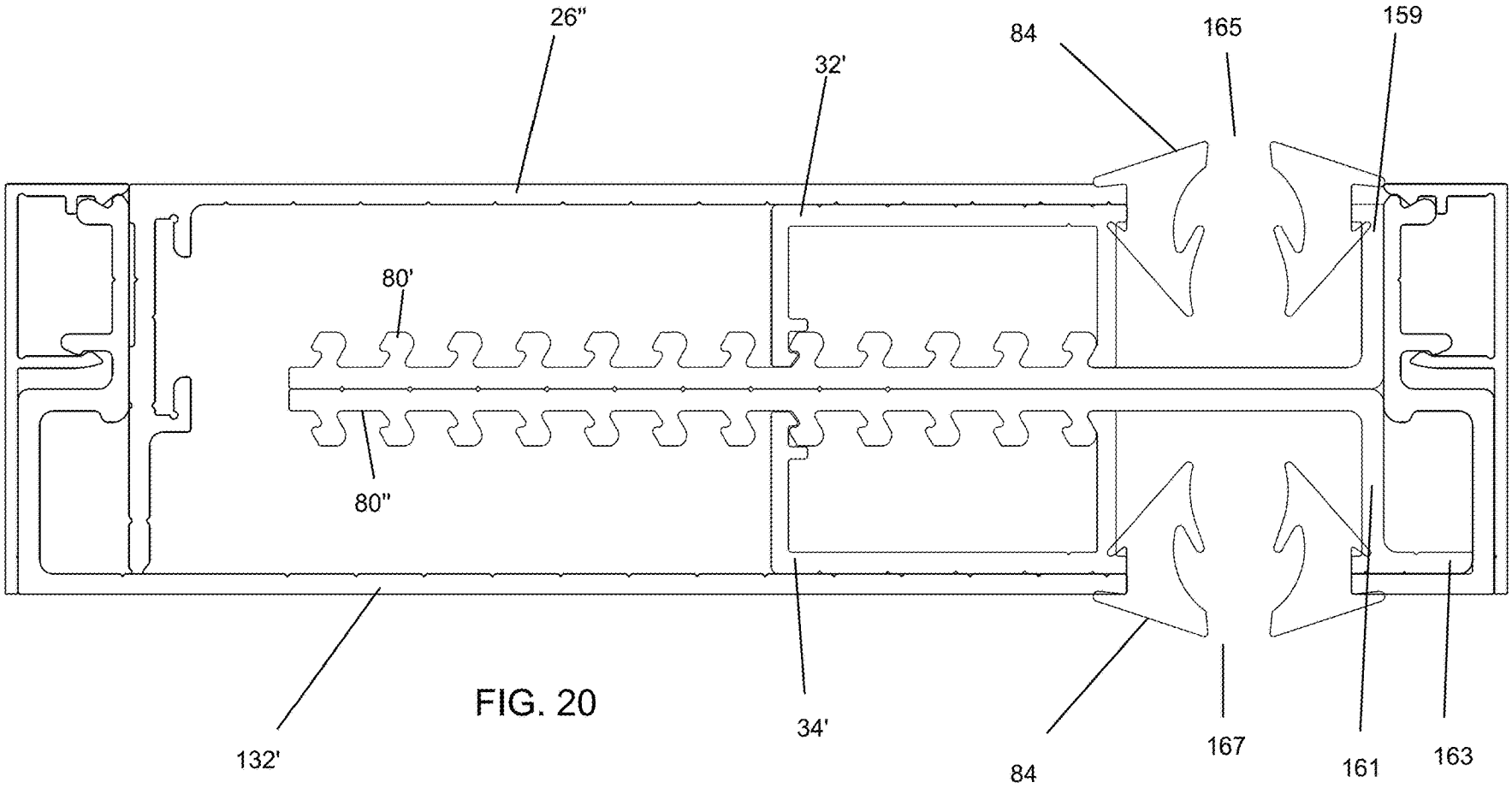
FIG. 20 illustrates a glass-at-side configuration.

FIG. 20 illustrates a glass-at-side configuration wherein a pair of modified glazing base members (80', 80") are positioned back to back. Each glazing base member (80', 80") has an additional right angle leg member (159, 161) but only one glazing base (80") has a horizontal extension (163). In this configuration, upper glazing cap (26') and glazing jamb cap (132') are provided with no latch hook members (54). Instead, modified glazing stops (32', 34') are provided to attach to the glazing base member hooks. The modified glazing stops (32', 34') may be adhered to the upper glazing cap (26') or glazing jamb cap (132') by suitable means such as welding, adhesive, etc. Glass may be installed at the openings (165, 167).

Figure 21:
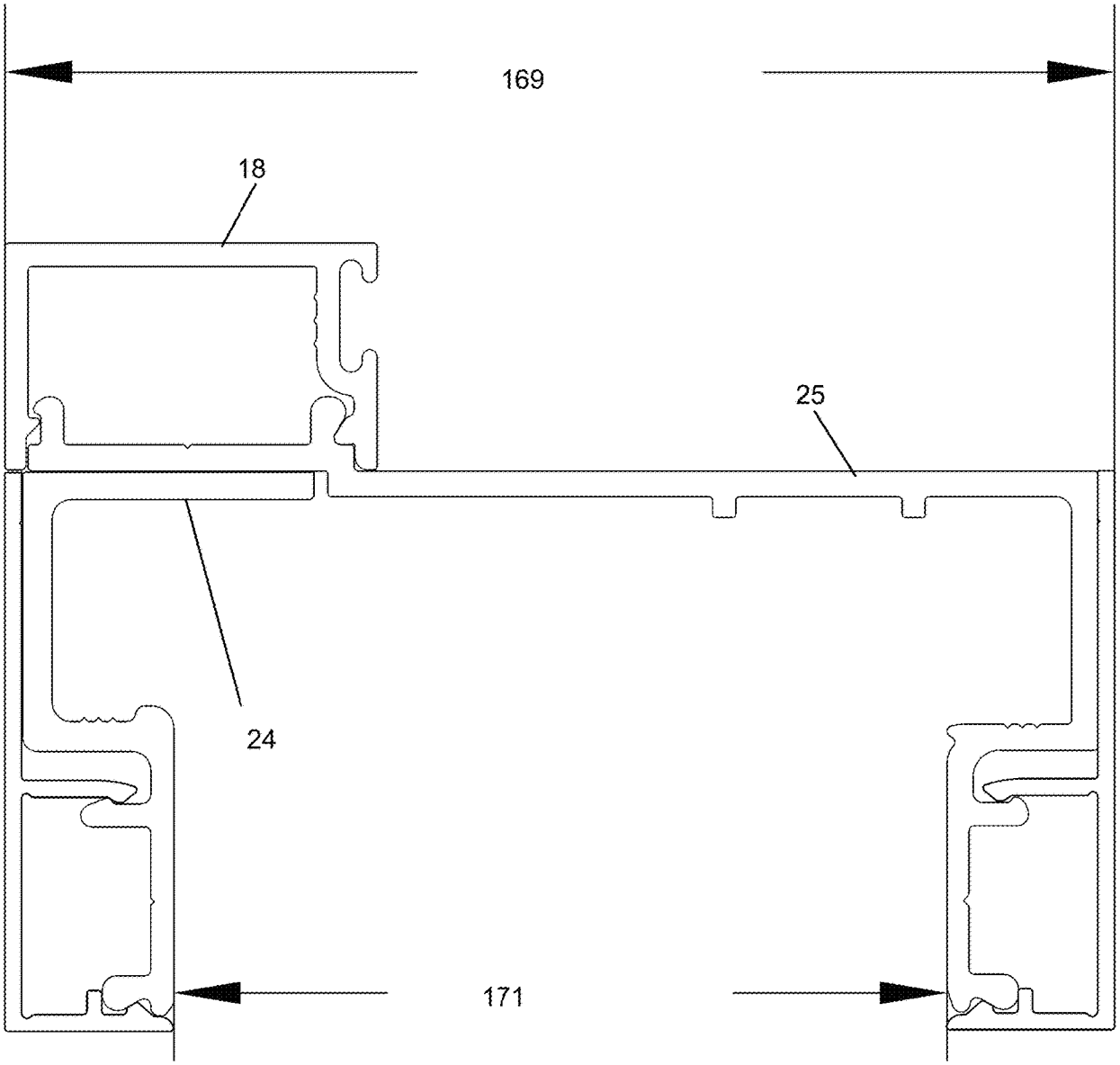
FIG. 21 illustrates the smallest door jamb-only configuration.

FIG. 21 illustrates a door jamb only configuration where a door stop (18) mounts to a door jamb leg (25) and a shortened jamb leg (92) is provided. In this configuration, dimensions (169) and (171) might be 2.982 and 2.0779 inches, for example.

Figure 22:
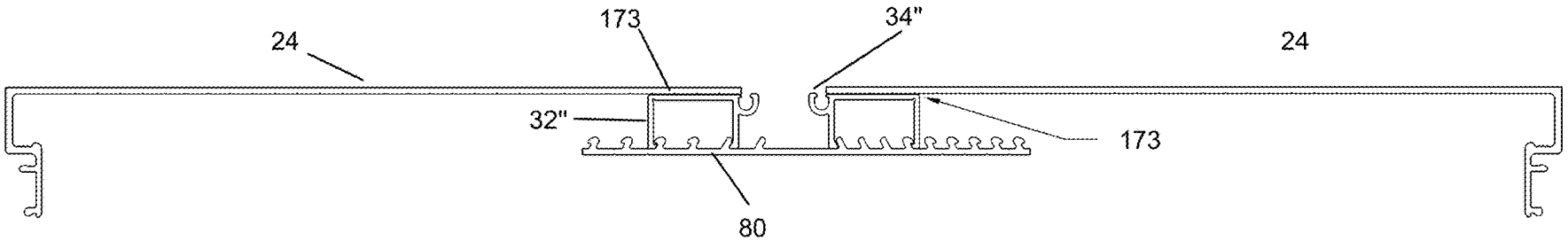
FIG. 22 illustrates an alternative glazing jamb assembly.

FIG. 22 illustrates an alternative glazing jamb assembly where a pair of jamb legs (24) are provided with glazing base (80) and alternate glazing stops (32", 34"). The glazing stops in this configuration may be secured to the jamb legs by double sided tape, glue, welding or suitable fasteners (173).

Figure 23:
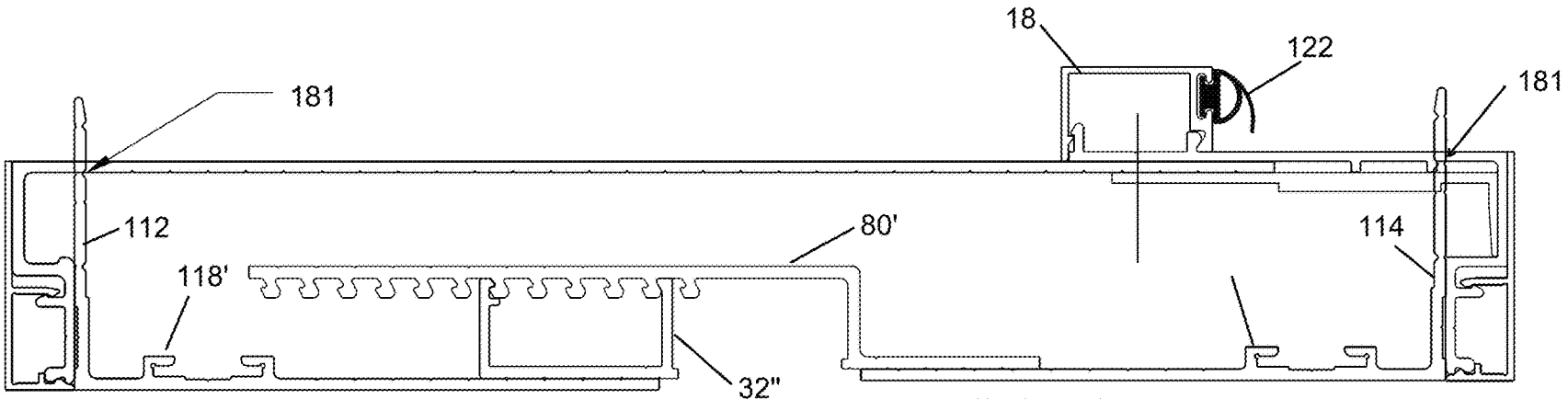
FIG. 23 illustrates an alternative doorjamb-with-sidelight-window configuration.

FIG. 23 illustrates an alternative door jamb with sidelight window configuration where the upper glazing cap (26') and jamb cap (24') are provided with no latch hook members (54), and modified glazing stops (32") are employed. Legs (112, 114) would be cut or snapped off (181). In this configuration, the mullion attachment clips (118') are at modified positions from the prior illustrated versions. A sound and light seal (122) is mounted to the door stop (18).

Figure 24:
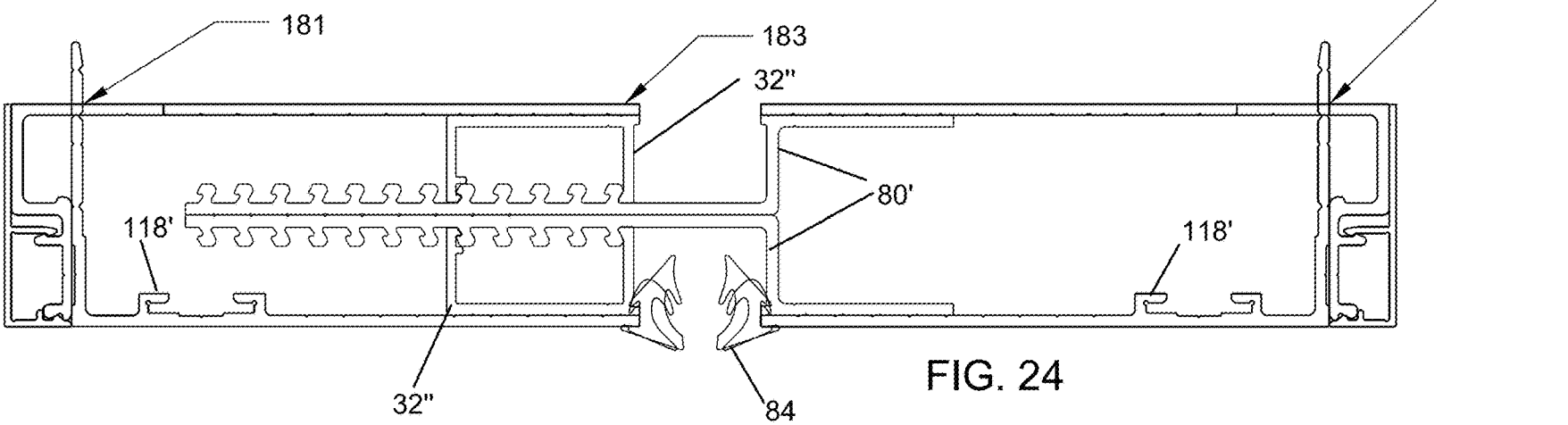
FIG. 24 illustrates an alternative vertical or horizontal mullion configuration.

FIG. 24 illustrates an alternative vertical or horizontal mullion configuration for double glass mounting where the jamb leg is cut or snapped off (183) to provide the desired $2^{nd}$ window mounting position.

Figure 25:
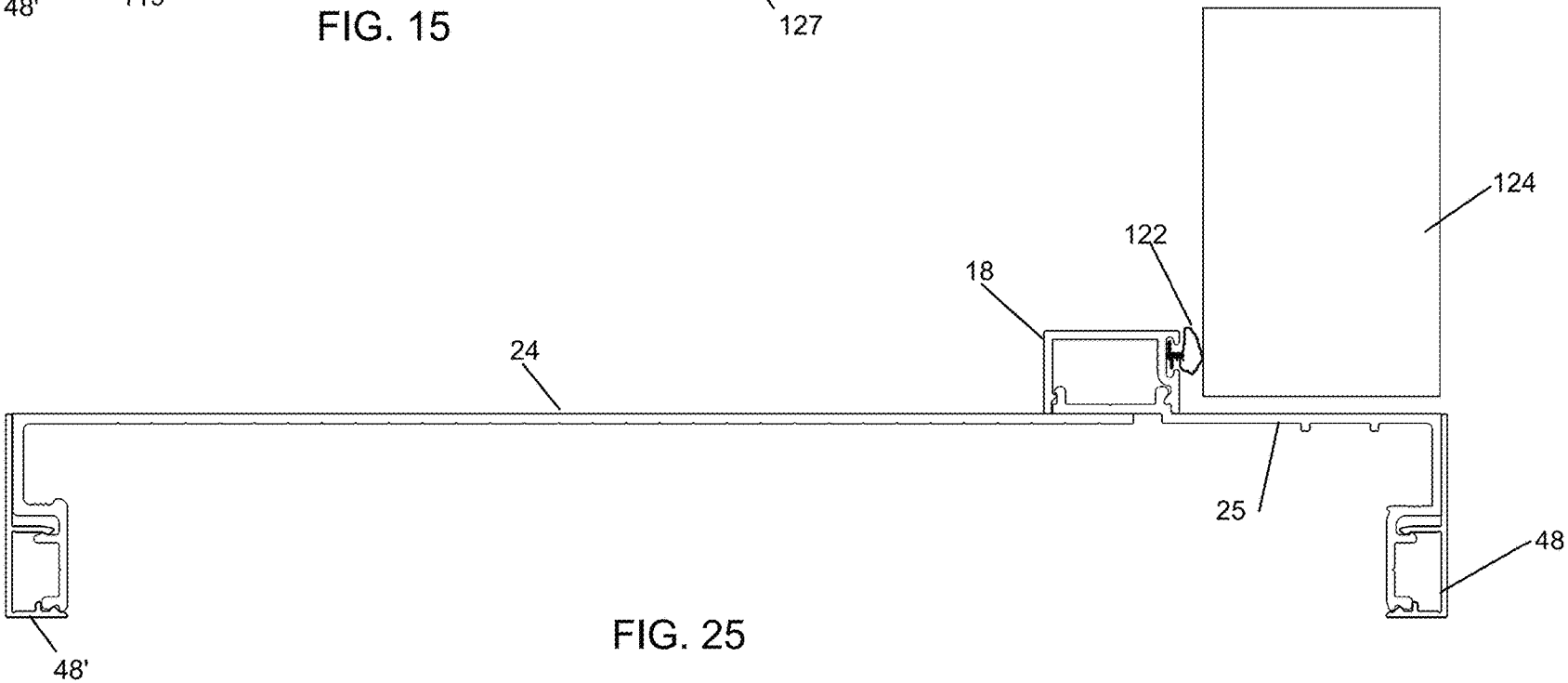
FIG. 25 illustrates an alternative door jamb only configuration.

FIG. 25 illustrates an alternative door jamb only configuration.

The various components can, rather than being snapped into place, be slid together in directions orthogonal to the surface of the drawing once aligned to the desired spacing, and the interaction of the hooks and lips holds the components together.

In a preferred embodiment, the various components may be made of aluminum although other materials may be used.

While a preferred embodiment of the technology has been shown and described, it will be apparent to those skilled in the art that many changes and modifications may be made without departing from the broader aspects. The appended claims are therefore intended to cover all such changes and modifications as fall within the true spirit and scope of the technology.

What is claimed is:

1. A frame system for windows or doors comprising:

a glazing base member;

a first glazing stop member;

a glazing cap member, wherein said glazing base member, said first glazing stop member and glazing cap member comprise interlocking interface features for enabling assembly together in variable spacing arrangement to provide a desired configuration for a frame for a window or door; and a second glazing stop member, said second glazing stop member comprising interlocking interface features for enabling assembly together with said glazing base member and said glazing cap member, wherein said interlocking interface features comprise base hook members defined on said glazing base member that interact with corresponding glazing stop hook members defined on said glazing stop members to fix said glazing base member and said first and second glazing stop members to one another, and wherein said interlocking interface features further comprise glazing cap hook members that have plural hook portions that interact with corresponding glazing base hook members to secure said glazing cap and said glazing base in position relative to one another.

2. A frame system for windows or doors comprising:

a glazing base member;

a first glazing stop member; and a glazing cap member, wherein said glazing base member, said first glazing stop member and glazing cap member comprise interlocking interface features for enabling assembly together in variable spacing arrangement to provide a desired configuration for a frame for a window or door, wherein said interlocking interface features comprise plural spaced hook members defined on a face of said glazing base member and on a face of said glazing cap member.

3. The frame system for windows or doors according to claim 2, wherein said plural spaced hook members are evenly spaced relative to one another.

4. The frame system for windows or doors according to claim 2, wherein a first set of said plural spaced hook members are evenly spaced relative to one another and a second set of said plural spaced hook members are differently spaced relative to spacing of said first set.

5. A frame system for receiving and supporting a window comprising:

a glazing base member;

a first glazing stop member;

a first glazing member received in said first glazing stop member;

a second glazing stop member;

a second glazing member received in said second glazing stop member;

a glazing cap member; and a glazing cap filler member, said glazing cap filler member engaging with said glazing cap member, wherein said glazing base member and said glazing cap member comprise plural spaced hook members and said first and second glazing stop members comprising interlocking hook members for selectively engaging with ones of said plural spaced hook members on said glazing base member and said glazing cap members for defining a spaced window receiving position between said first and second glazing members to provide a desired configuration for a window receiving frame.

6. The frame system for windows or doors according to claim 5, wherein said plural spaced hook members are evenly spaced relative to one another.

7. The frame system for windows or doors according to claim 5, wherein a first set of said plural spaced hook members are evenly spaced relative to one another and a second set of said plural spaced hook members are differently spaced relative to spacing of said first set.

8. The frame system for windows or doors according to claim 5, further comprising a jamb leg and a door jamb leg adapted for interaction with said glazing cap member for defining a desired jamb depth.

9. A method for providing a frame system for windows or doors comprising:

providing a glazing base member;

providing a first glazing stop member;

providing a glazing cap member, wherein said glazing base member, said first glazing stop member and said glazing cap member comprise interlocking interface features for enabling assembly together in variable spacing arrangement to provide a desired configuration for a frame for a window or door; and providing a second glazing stop member, said second glazing stop member comprising interlocking interface features for enabling assembly together with said glazing base member and said glazing cap member, wherein said interlocking interface features comprise base hook members defined on said glazing base member that interact with corresponding glazing stop hook members defined on said glazing stop members to fix said glazing base member and said first and second glazing stop members to one another, and wherein said interlocking interface features further comprise glazing cap hook members that have a plural hook portions that interact with corresponding glazing base hook members to secure said glazing cap and said glazing base in position relative to one another.

10. A method for providing a frame system for windows or doors comprising:

providing a glazing base member;

providing a first glazing stop member; and providing a glazing cap member, wherein said glazing base member, said first glazing stop member and said glazing cap member comprise interlocking interface features for enabling assembly together in variable spacing arrangement to provide a desired configuration for a frame for a window or door, wherein said interlocking interface features comprise plural spaced hook members defined on a face of said glazing base member and on a face of said glazing cap member.

11. The method according to claim 10, wherein a first set of said plural spaced hook members are evenly spaced relative to one another and a second set of said plural spaced hook members are differently spaced relative to spacing of said first set.

* * * * *